US009755306B1

(12) United States Patent
Ogilvie

(10) Patent No.: US 9,755,306 B1
(45) Date of Patent: Sep. 5, 2017

(54) WIDEBAND ANTENNA DESIGN FOR WIDE-SCAN LOW-PROFILE PHASED ARRAYS

(71) Applicant: LOCKHEED MARTIN CORPORATION, Bethesda, MD (US)

(72) Inventor: Timothy Bryan Ogilvie, San Jose, CA (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 779 days.

(21) Appl. No.: 14/149,736

(22) Filed: Jan. 7, 2014

Related U.S. Application Data

(60) Provisional application No. 61/749,856, filed on Jan. 7, 2013.

(51) Int. Cl.
*H01Q 3/30* (2006.01)
*H01P 11/00* (2006.01)

(52) U.S. Cl.
CPC ..... *H01Q 3/30* (2013.01); *H01P 11/00* (2013.01)

(58) Field of Classification Search
USPC ..... 343/700 MS
See application file for complete search history.

(56) References Cited

U.S. PATENT DOCUMENTS

| | | | | |
|---|---|---|---|---|
| 4,903,033 | A | 2/1990 | Tsao et al. | |
| 6,018,319 | A | 1/2000 | Lindmark | |
| 6,239,762 | B1 * | 5/2001 | Lier | H01Q 13/10 343/700 MS |
| 6,624,787 | B2 | 9/2003 | Puzella et al. | |
| 2002/0044098 | A1 * | 4/2002 | Von Stein | H01Q 1/38 343/770 |
| 2003/0067410 | A1 * | 4/2003 | Puzella | H01Q 9/0407 343/700 MS |
| 2005/0235482 | A1 * | 10/2005 | Deaett | H01P 11/00 29/600 |
| 2006/0152414 | A1 * | 7/2006 | Peshlov | H01Q 21/0075 343/700 MS |
| 2007/0285324 | A1 * | 12/2007 | Waterhouse | H01Q 1/273 343/718 |
| 2008/0111759 | A1 * | 5/2008 | Hjelmstad | G01S 3/023 343/859 |

* cited by examiner

*Primary Examiner* — Sean P Burke
(74) *Attorney, Agent, or Firm* — McDermott Will & Emery LLP

(57) ABSTRACT

An antenna cell for a wide-scan low-profile phased array system includes an antenna layer including one or more stacked conductive radiators configured to receive electromagnetic waves. The antenna cell also includes a feed layer that includes multiple rectangular slots and one or more feed structures. Each rectangular slot may excite an orthogonal polarization. The feed structures are positioned perpendicular to one another, and each of the feed structures includes a feed fork that includes a set of open-circuit stubs and is configured to tune antenna performance.

16 Claims, 18 Drawing Sheets

WIDEBAND ANTENNA DESIGN FOR WIDE-SCAN LOW-PROFILE PHASED ARRAYS

CROSS-REFERENCE TO RELATED APPLICATIONS

This application claims the benefit of priority under 35 U.S.C. §119 from U.S. Provisional Patent Application 61/749,856 filed Jan. 7, 2013, which is incorporated herein by reference in its entirety.

STATEMENT REGARDING FEDERALLY SPONSORED RESEARCH OR DEVELOPMENT

Not applicable.

FIELD OF THE INVENTION

The present invention generally relates to antenna design, and more particularly to wideband antenna design for wide-scan low-profile phased arrays.

BACKGROUND

In an analog phased array radio-frequency (RF) front-end, each antenna may receive and transmit two orthogonally polarized electromagnetic waves. Switches and/or filters may provide channel or beam selectivity and can be implemented in RF micro-electromechanical systems (MEMS) technology for reduced insertion loss (e.g. best noise figure). An amplification stage may be followed by fundamental elements of analog beam-forming, such as phase shifters or time delay units, variable attenuators, and summing circuits. Controlling amplitude and phase shift (or time delay for very large aperture or very wideband arrays) of each channel may implement a coherent weighted sum used to electronically reconfigure the far-field radiation pattern (e.g., to form beams or place nulls). As the size of the aperture and the number of antennas increases, beamwidth may narrow and directivity may increase.

To reduce overall system cost, many of the components can be consolidated into integrated circuits or multi-chip modules and collocated on a multilayer printed circuit board. Further reduction in system cost can be achieved through the utilization of lowest-cost technology nodes and processes, such as silicon-germanium (SiGe), for consolidation of beam-forming elements. Higher component consolidation allows for reduction in unit cell size, and consequently, extension of scan volume for a fixed maximum operational frequency, or extension of maximum operational frequency for a fixed scan volume. Recent advancements in the state-of-the-art for phased arrays include multiple unit-cell multilayer antennas integrated into subarrays by stacking up the same multilayer antennas. Such phased arrays have achieved up to 30% bandwidth, up to 30 degrees conical scan volume, and thicknesses on the order of one inch, in designs that can be instantiated from S- to X-bands. Some applications may require a wider bandwidth and closer spacing, which may typically lead to large profile antennas that no longer can maintain a low-profile feature. Therefore, the need exists for a wideband antenna unit cell design for wide-scan, low-profile, and low-cost phased arrays.

SUMMARY

In some aspects, an antenna cell for a wide-scan low-profile phased array system includes an antenna layer including one or more stacked conductive radiators configured to receive electromagnetic waves; and a feed layer that includes multiple rectangular slots and one or more feed structures. Each rectangular slot may excite an orthogonal polarization. The feed structures are positioned perpendicular to one another, and each of the feed structures comprises a feed fork that includes a set of open-circuit stubs and is configured to tune antenna performance.

In other aspects, a method for providing an antenna cell for a wide-scan low-profile phased array system includes forming an antenna layer including one or more stacked conductive radiators configured to receive electromagnetic waves; and forming a feed layer comprising multiple rectangular slots and two or more feed structures. The feed layer may be formed by configuring each of the rectangular slots to excite an orthogonal polarization, and positioning the two or more feed structures perpendicular to one another. Each of the feed structures may include a feed fork including a set of open-circuit stubs that are configured to tune antenna performance.

In yet other aspects, a wide-scan low-profile phased array system includes multiple antenna cell units positioned in a two-dimensional lattice. Each antenna cell unit may include an antenna layer and a feed layer. The antenna layer may include one or more stacked conductive radiators that are configured to receive electromagnetic waves. The feed layer may include two or more feed structures including a top-stripline feed structure and a bottom stripline feed structure each coupled to a port. Each of the top-stripline feed structure and the bottom stripline feed structure includes a two teeth feed fork. Each tooth may include a corner stub extending out from another tooth of the two teeth.

The foregoing has outlined rather broadly the features of the present disclosure in order that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein.

DETAILED DESCRIPTION

The present disclosure is directed, in part, to methods and configuration for providing a wideband antenna unit cell design for wide-scan, low-profile, and low-cost phased arrays. The subject technology may relate to unit cell antenna designs of highly integrated tile-type electromagnetic phased arrays implemented with low-cost printed circuit board manufacturing materials and processes, which may be particularly suited for low-profile, wide-scan, and wideband arrays constructed from a plurality of subarrays that contain a plurality of unit cells. The unit cell of a phased array may refer to the elementary building block, from which the entire phased array system is constructed. The size of the unit cell, represented mathematically as a discrete spatial aperture sample, may dictate the scan volume. The scan volume may be defined in terms of a far-field radiation pattern containing no grating lobes that is generated by a plurality of antenna unit cells placed in a two-dimensional lattice. The grating lobes are artifacts of spatially undersampled apertures.

Bandwidth enhancement of low-cost PCB manufactured planar phased array antenna elements may be achieved by using various feeding mechanisms and radiator shapes and orientations. For the multilayer PCB phased arrays, proximity/capacitive-coupled or aperture/slot-coupled feeds may be generally preferred even though they can be more complicated to manufacture.

Figure 1:
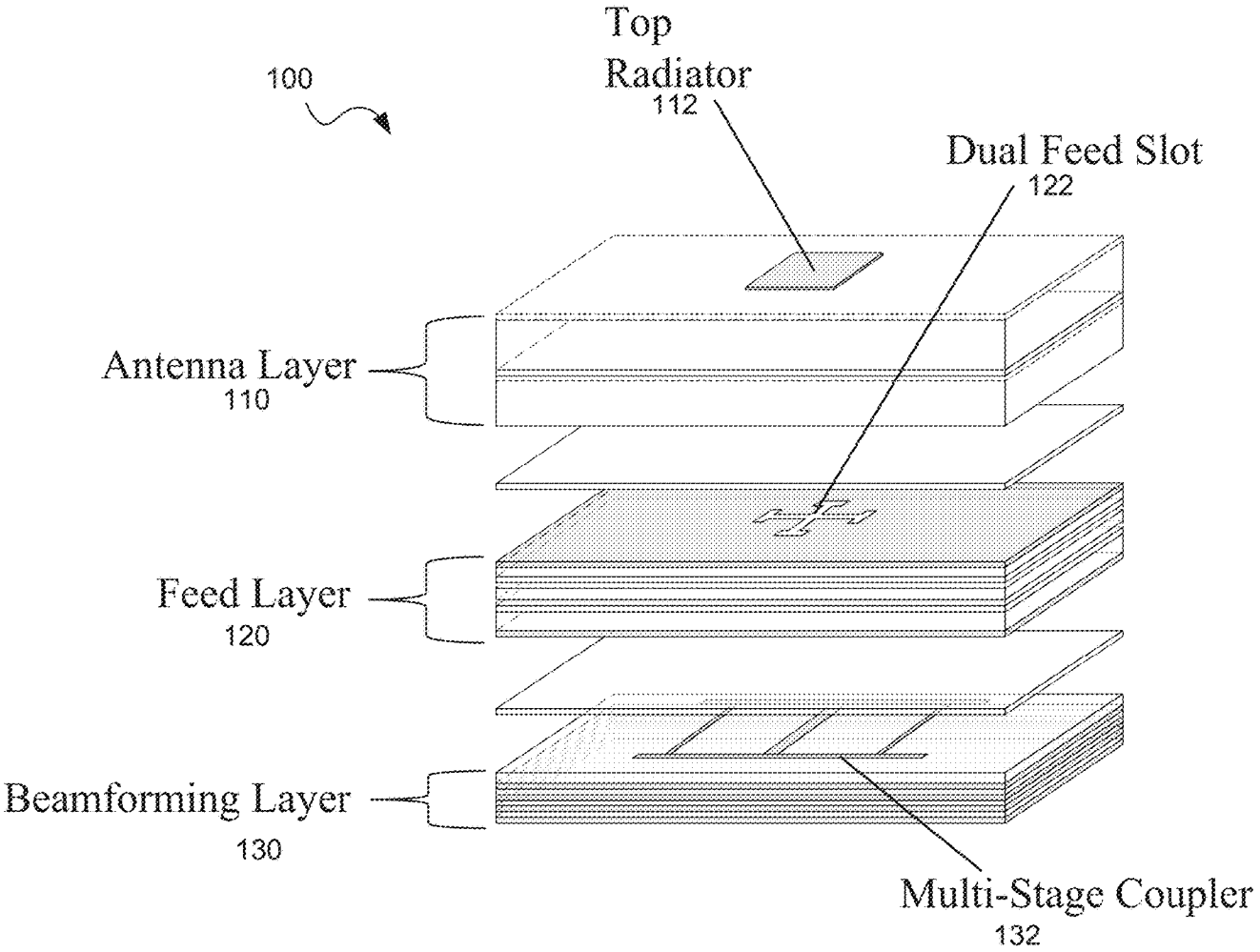
FIG. 1 illustrates a conceptual diagram of an example structure of a unit cell antenna, according to certain aspects.

FIG. 1 illustrates a conceptual diagram of an example structure of a unit cell antenna 100, according to certain aspects. The unit cell antenna 100 may an antenna layer 110, a feed layer 120, and a beam-forming layer 130. The antenna layer 110 may include one or more stacked conductive radiators including a top radiator 112. The antenna layer 110 may be configured to receive and/or propagate electromagnetic waves (e.g., radio-frequency (RF) signals). The shape, dimensions, and spacing of the radiators are selected to promote a desired radiation mechanism and maintain a desired far-field radiation pattern, while utilizing commercially available printed circuit board (PCB) laminate materials and fabrication processes.

The feed layer 120 may include a dual feed slot 122 formed by multiple rectangular slots each containing a set of open circuit slots and one or more feed structures. Each rectangular slot may excite an orthogonal polarization. The feed structures are positioned perpendicular to one another, and each of the feed structures may include a feed fork that includes a set of open-circuit stubs and is configured to tune antenna performance, as described in more detail herein. The beam-forming layer 130 may include a number of multi-stage branch-line couplers 132 and other components. The other components may include externally mounted integrated circuits, multi-chip modules, or similar electronics packages, utilized to achieve either analog or digital beam-forming. A phased array system front-end may consist of a plurality of said unit cells positioned in a two-dimensional lattice and integrated into a plurality of multilayer printed circuit boards which can be conformed to a multi-dimensional surface.

Figure 2:
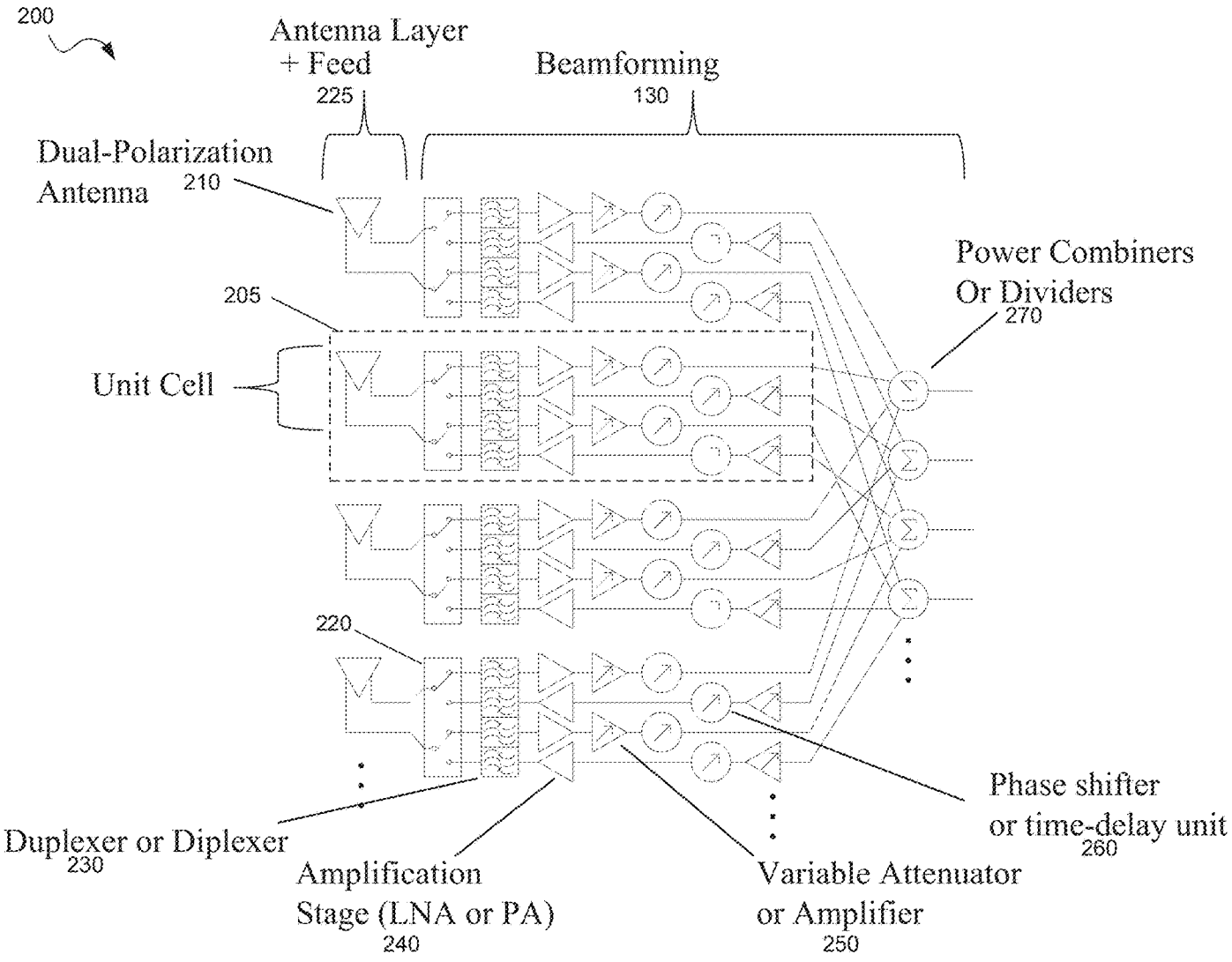
FIG. 2 illustrates an example of a schematic of a generalized phased array RF front-end for analog beam-forming, according to certain aspects.

FIG. 2 illustrates an example of a schematic diagram of a generalized phased-array RF front-end 200 for analog beam-forming, according to certain aspects. The phased-array RF front-end 200 includes a number of unit cells 205, each of which supports a unit cell antenna (e.g., 100 of FIG. 1) and includes an antenna-plus-feed portion 225 and a beam-forming portion 130. The antenna-plus-feed portion 225 includes a dual polarization (e.g., dual linearly polarized antenna 210 and a feed portion that is described with respect to FIG. 3. Each antenna can receive and transmit two (orthogonally) polarized electromagnetic waves. The unit cell 205 supports transmit (RX) and receive (TX) channels for two polarizations (e.g., vertical and horizontal). The unit cell 205 includes a number of blocks including a set of switches 220, duplexers and/or diplexers 230, amplification stages (e.g., low-noise amplifier (LNA) in the RX-channels) or power amplifier (PA) (e.g., in the TX-channels), variable attenuator or amplifiers 250, and phase shifters (e.g., time delay units) 260. The switches 220 may include filters and can provide channel or beam selectivity. The blocks of the unit cell 205 are known and their further description is skipped herein for the sake of brevity. Summing circuits (e.g., power combiners or dividers) 270 may combine the signals from the respective RX channels or divide TX signals between the respective TX channels. Coherent weighted sums may be used to electronically reconfigure the far-field radiation pattern (e.g., to form beams or place nulls) by controlling amplitude and phase shift of each channel.

Figure 3:
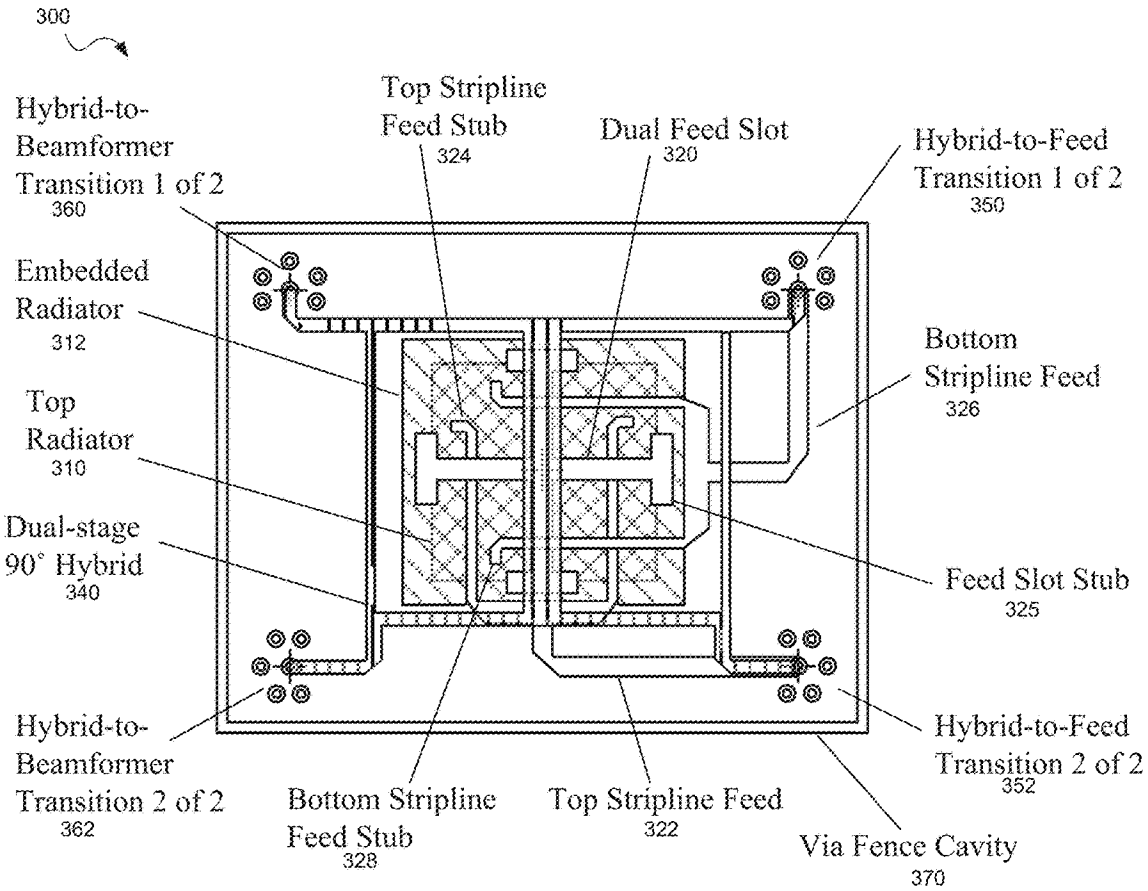
FIG. 3 illustrates a top-view diagram of an example design of a unit cell antenna, according to certain aspects.

FIG. 3 illustrates a top-view diagram of an example design of a unit cell antenna 300, according to certain aspects. The unit cell antenna 300, as shown in FIG. 3, includes a top radiator 310 and an embedded radiator 312 of the antenna layer (e.g., 110 of FIG. 1), a dual feed slot 320 with feed slot stubs 325, a top stripline feed structure 322, a top stripline feed stub 324, a bottom stripline feed structure 326, a bottom stripline feed stub 328, a dual stage 90° hybrid (e.g., a multi-stage branch-line coupler) 340, Hybrid-to-feed transitions 350 and 352, hybrid-to-beam-former transitions 360 and 362, and a via fence cavity 370.

In one or more aspects of the subject technology, circular polarization may be achieved with the two-stage stripline and a branch-line coupler implemented in the beam-forming layer by the top and bottom stripline feed structures 322 and 326 and the dual stage 90° hybrid 340, respectively. Six-via transitions (e.g., 350 and 352) couple two stripline and feed forks (e.g., 326 and 322) in the feed layer to hybrid couplers, which are shaped to maximize port-to-port isolation and minimize input reflection coefficient. Each stripline feed fork may couple to a slot (e.g., of the dual feed slot 320) in the upper ground plane of the stripline structure. Two slots of dual feed slot 320, one for each of the feed forks, may be perpendicular and have different slot widths and the same slot length. Each slot may contain two symmetrical open circuit slot stubs 325. The stub length and width can be the same or different for each feed, but are symmetric about the centerline for each feed. A bottom conductive radiating patch (e.g., 312) is located above the slotted ground plane, and a top conductive patch (e.g., 310) is located above the bottom patch 312.

The top stripline feed stub 324 and the bottom stripline feed stub 328 are open circuit stubs that are shaped to adjust coupling between the two feed forks. The top stripline feed structure 322 and the bottom stripline feed structure 326 may be vertically and horizontally polarized, respectively. These polarizations are linear, and the dual stage 90° hybrid (e.g., a multi-stage branch-line coupler) 340 can convert these dual linear polarizations to a dual circular polarization to provide a circularly polarized antenna. The material within the antenna layer region may be of a lower dielectric constant than the beam-forming and feed layers.

Feeding mechanisms responsible for transitioning from guided transmission lines to radiating transducers may include proximity/capacitive-coupled probes, direct ohmic contact probes, or slot/aperture-coupled probes. Direct ohmic contact feeds may deliver the narrowest bandwidth (e.g., less than 3%), which may be defined as the ratio of the frequency band where return loss exceeds 10 dB over the mid-frequency. This is because the direct ohmic contact feeds may be limited from expansion in the direction normal to the printed radiator plane by probe inductance or are limited by the microstrip transmission line substrate thickness in the case of the coplanar, inset microstrip feed. Additionally, a coplanar direct feed typically may result in a non-symmetrical far-field radiation pattern caused by interaction with the feed structure, which may be non-symmetric for both single and dual fees. Consequently, for multilayer PCB phased arrays, proximity capacitive-coupled or aperture/slot-coupled feeds may be generally preferred even though they can be more complicated to manufacture.

The feed and beam-forming layers may be encircled by the via fence cavities 370 at the boundaries of the unit cell antenna 300. The via fence cavities 370 may completely enclose the unit cell antenna 300, thereby reducing coupling between adjacent channels and suppressing parallel-plate modes that may lead to scan blindness or other commonly encountered undesirable performance degradation. For high-power or space applications, the unit cell via fence cavities 370 may provide improvement to thermal conductivity to draw excess heat away from components mounted to the exterior of the beam-forming layer.

Figure 4:
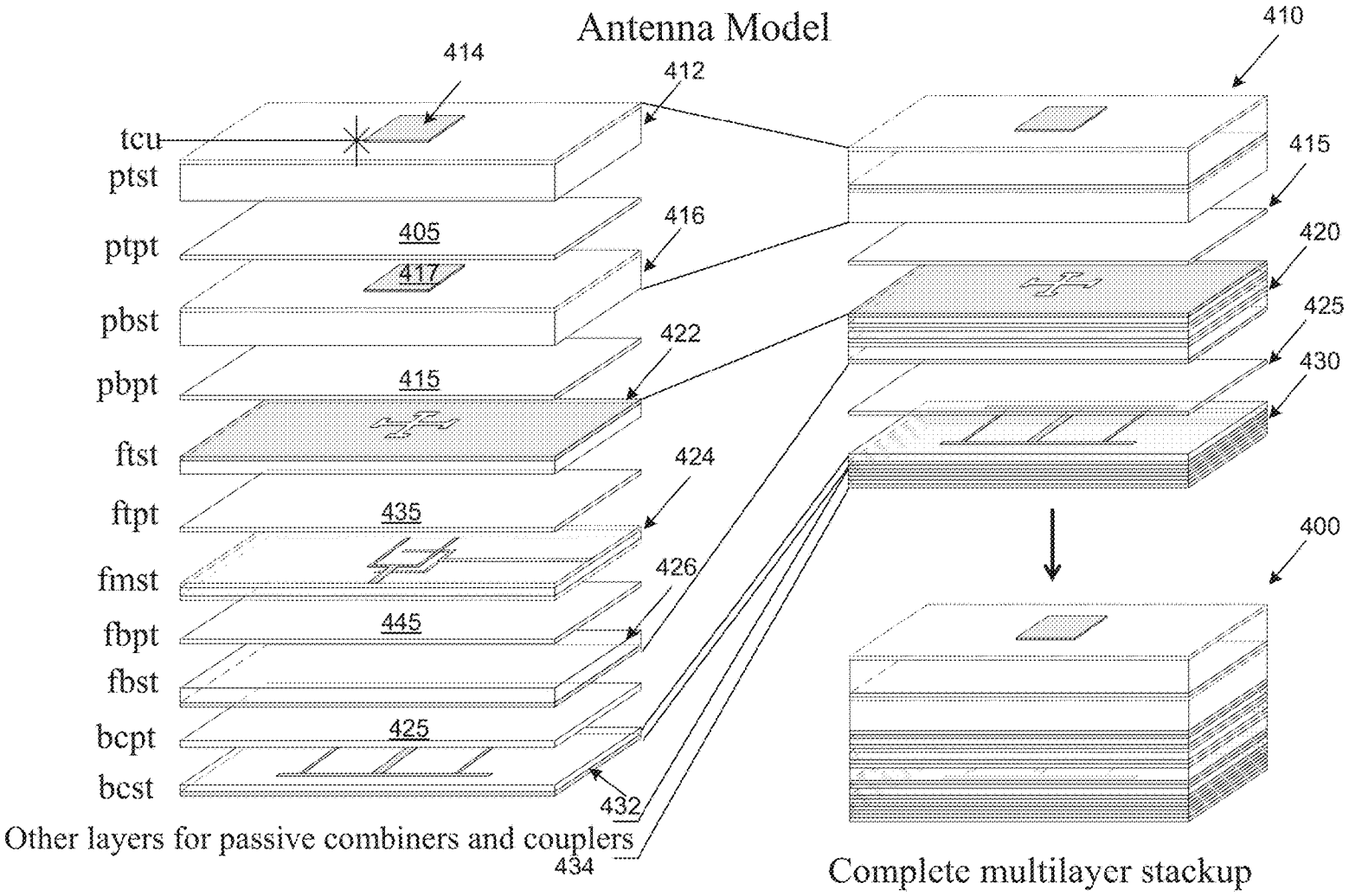
FIG. 4 illustrates examples of various layers of a printed circuit board stack-up of an antenna cell and the associated antenna model parameters, according to certain aspects.

FIG. 4 illustrates examples of various layers of a printed circuit board (PCB) stack-up 400 of an antenna cell and the associated antenna model parameters, according to certain aspects. The stack-up 400 is formed by the antenna layer 410, the feed layer 420, the beam-forming layer 430, a ground plane (e.g., RF ground plane) 415, and an isolation layer 425. As shown in the blown-up diagram on the left-hand side, the antenna layer 410 includes a stacked conductive radiator including layers 412, 405, and 416. The layer 412 is a top substrate, on which a top conductive patch 414 is formed (e.g., coated). The layer 416 is a bottom substrate, on which a bottom conductive patch 417 is formed. The layer 405 is a non-conductive layer that isolates the top and bottom radiators.

The feed layer 420 is formed by a feed-top substrate 422 including the cross-shaped dual feed slot (e.g., 320 of FIG. 3), an isolation layer 435, the feed forks layer 424 that includes the top and bottom stripline feeds 322 and 326 of FIG. 3, and a substrate layer 426 under an isolation layer 445, which may play a role in reducing the coupling between the top and the bottom stripline feeds 322 and 326 to improve cross-polarization of the antenna cell. The beam-forming layer 430 includes the substrate 432, on which the dual-stage 90° hybrid 430 of FIG. 3 is formed and is isolated from the feed layer 420 by an isolation layer 425. In some aspects, various layers of the stack up 400 are compatible with PCB fabrication process. The associated antenna model parameter for material thickness of each layer is shown on the left-hand side of each layer (e.g., tcu, ptst, ptpt, et.).

Figure 5:
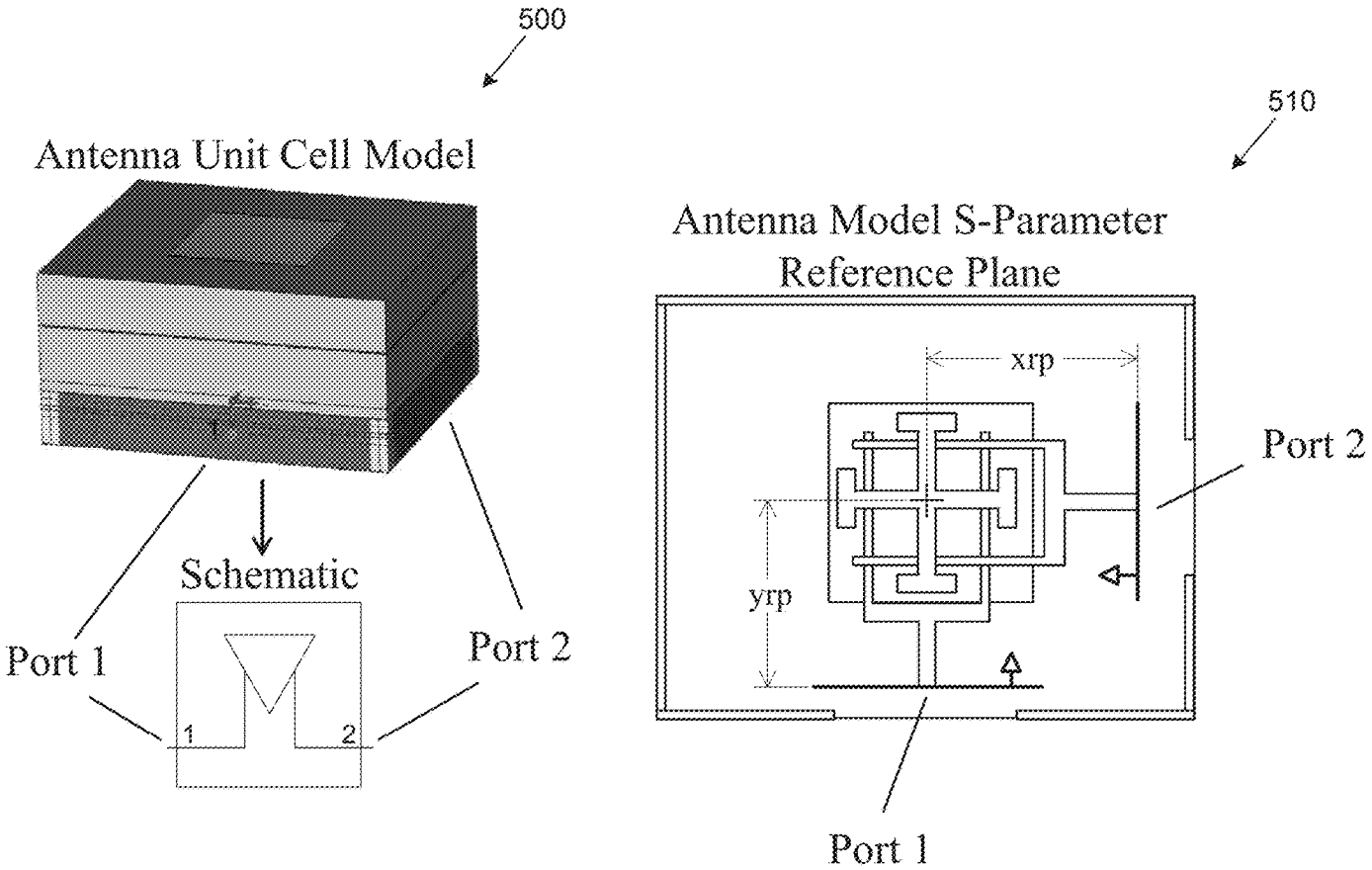
FIG. 5 illustrates an example of an antenna unit cell model with ports and reference planes highlighted, according to certain aspects.

FIG. 5 illustrates an example of a model 510 of an antenna unit cell 500 with ports and reference planes highlighted, according to certain aspects. The example model 510 is an S-parameter reference plane for the antenna unit cell 500 where some of the model parameters (e.g., xrp and yrp) are defined based on the geometry of the structure of a portion of the antenna unit cell 500. The ports 1 and 2 of the antenna unit cell 500, as shown in the schematic (e.g. 210 of FIG. 2), are also shown in the model 510 and used as reference points for the parameters xrp and yrp, respectively.

Figure 6:
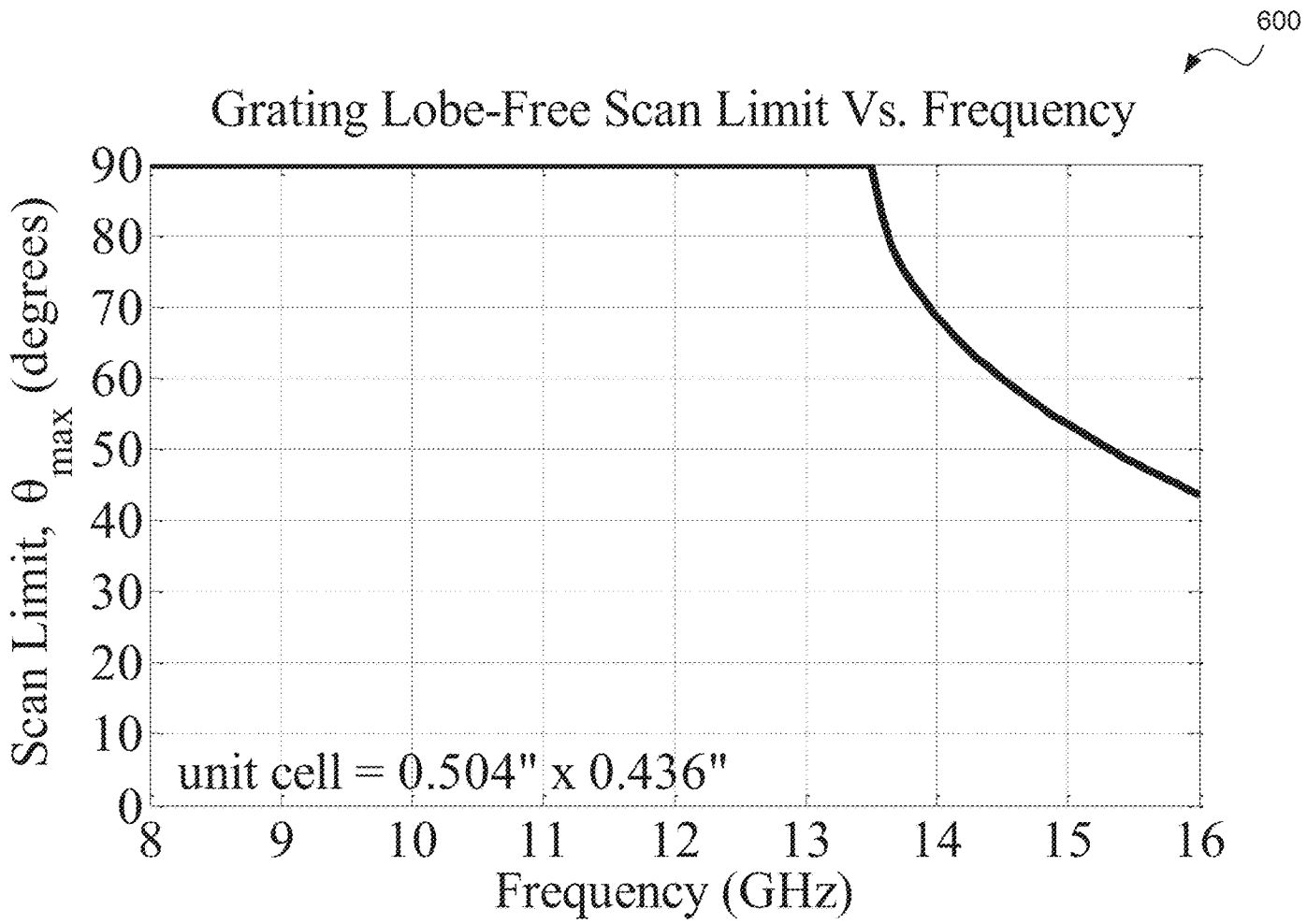
FIG. 6 illustrates an example of a relationship between a grating-lobe free scan limitation of elevation (theta) and frequency for a conical scan phased array, according to certain aspects.

FIG. 6 illustrates an example plot 600 of a relationship between a grating-lobe free scan limitation of elevation (theta) and frequency for a conical scan phased array, according to certain aspects. As seen from the plot 600, a phased array made of unit cell antenna of the subject technology (e.g., 100 of FIG. 1) can achieve a grating-lobe free conical scan volume with a scan angle of approximately 60 degrees at approximately 14.5 GHz, which corresponds to an upper limit for very small aperture terminal (VSAT) communication. Within this scan volume bound by $\theta_{max}$, defined as the elevation angle subtended by the mechanical bore-sight vector of the phased array and the vector representing the point direction, the far-field radiation pattern does not contain grating lobes. The unit cell antenna considered here is a small rectangular unit cell with x and y dimensions of approximately 0.5 and 0.44 inches.

Figure 7:
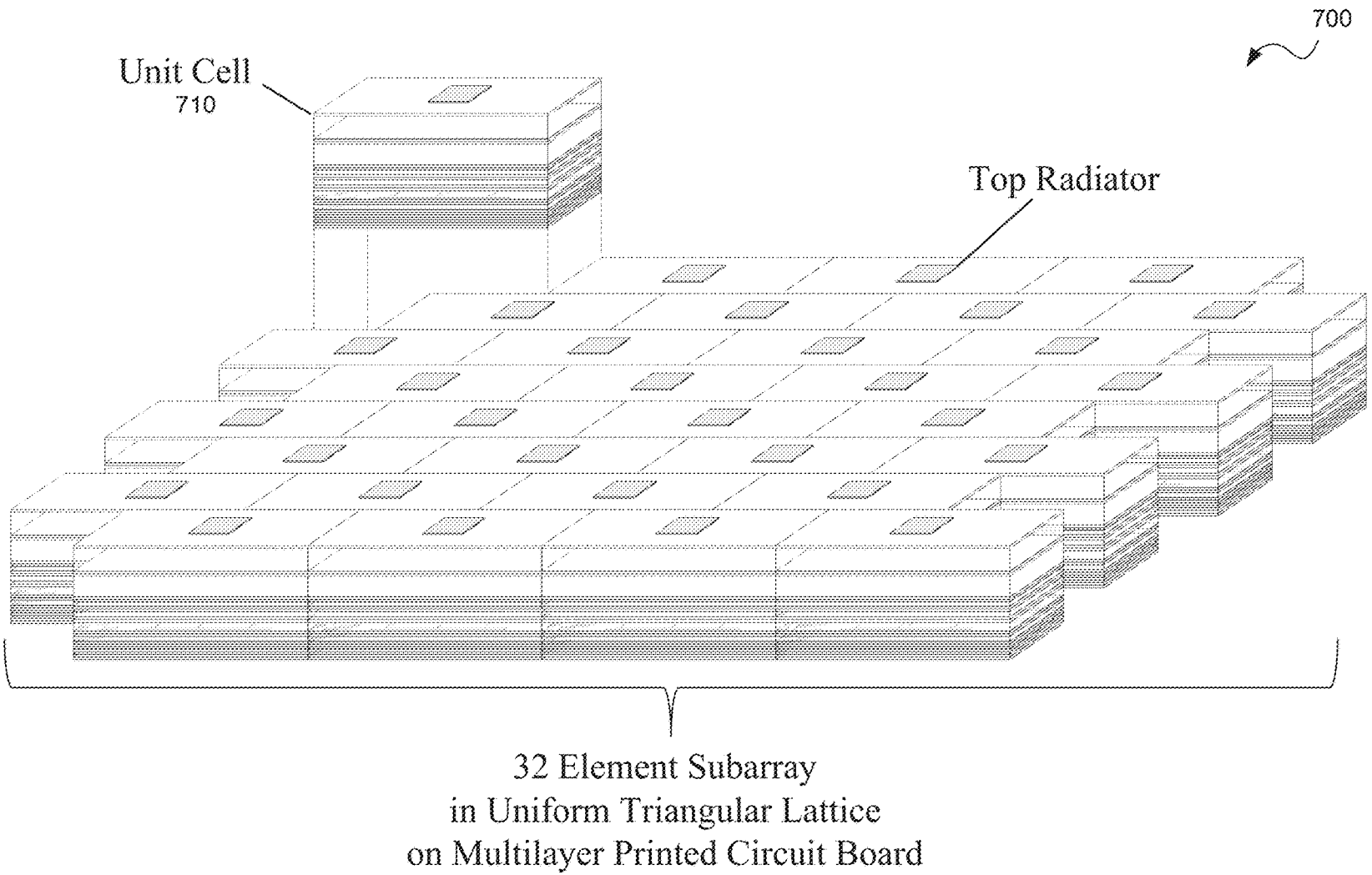
FIG. 7 illustrates an example of a subarray consisting of multiple unit cells in an integrated multilayer printed circuit board, according to certain aspects.

FIG. 7 illustrates an example of a subarray 700 including multiple unit cells 710 in an integrated multilayer printed circuit board, according to certain aspects. The subarray 700 includes a number of (e.g., 32) unit cells 710 arranged in triangular lattice, which is formed by periodic repetition of multiple triangular lattice units, where each lattice unit includes three unit cells. The triangular lattice is desirable because it allows inter-element spacing to increase by roughly 15% for a similar grating-lobe free scan range achieved by the same number of elements aligned in a square lattice. A square lattice, however, may be more desirable to achieve a maximal power-aperture product or for ease of manufacturing, as may be the case for compact phased arrays used in high-power radar, especially those employing the "brick" architecture. For phased arrays comprised of the unit cell provided in this disclosure, electrical performance (e.g., return loss and scan characteristics) may remain consistent regardless of the lattice selected to best suit the application.

Figure 8:
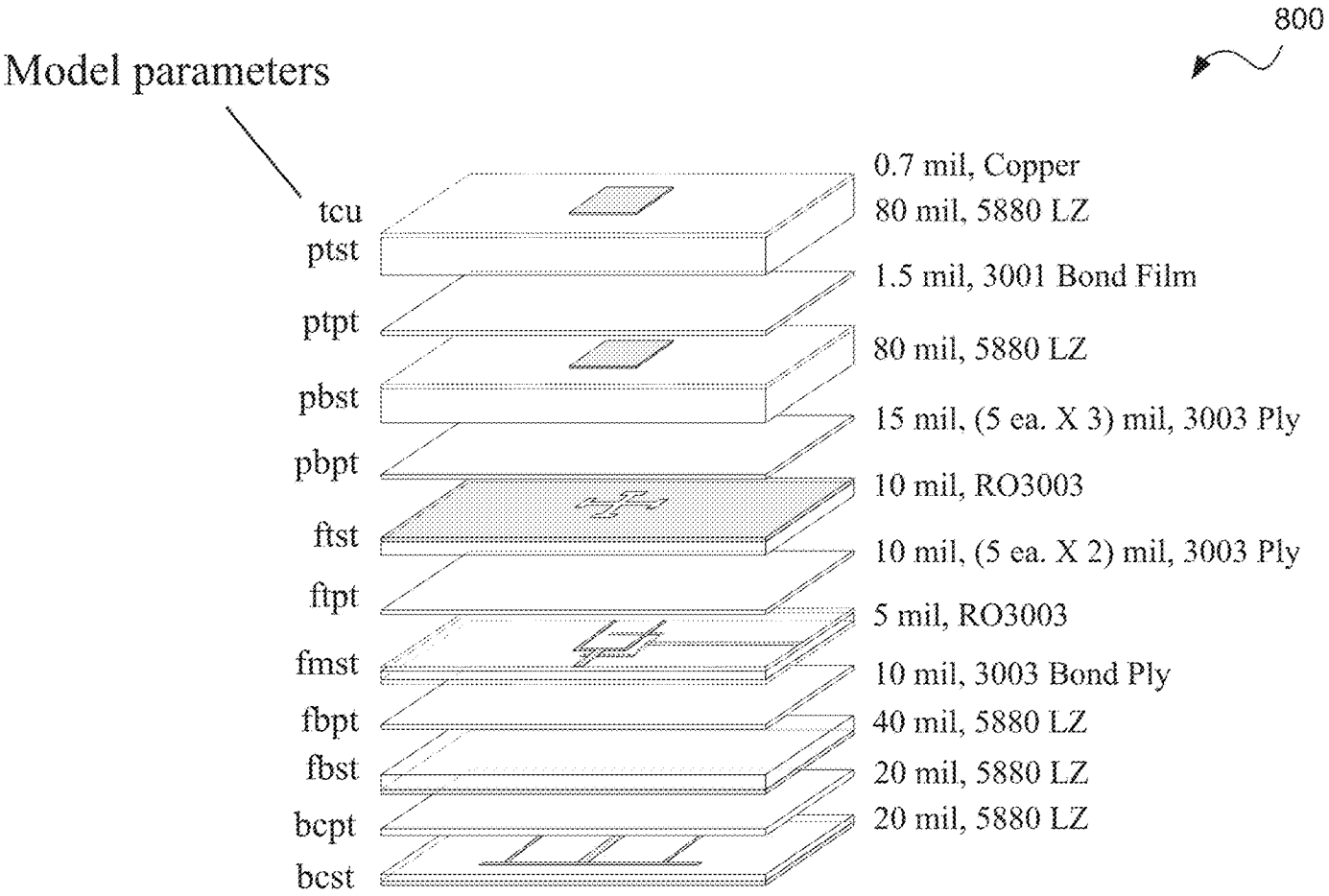
FIG. 8 illustrates an example of a stack-up of a unit cell with model parameters, thicknesses, and commercially available materials, according to certain aspects.

FIG. 8 illustrates a diagram of an example of a stack-up of a unit cell 800 with model parameters, thicknesses, and commercially available materials, according to certain aspects. This diagram is self-explanatory as it shows a model parameter, a thickness, and a material for each layer of the unit cell stack-up.

Figure 9:
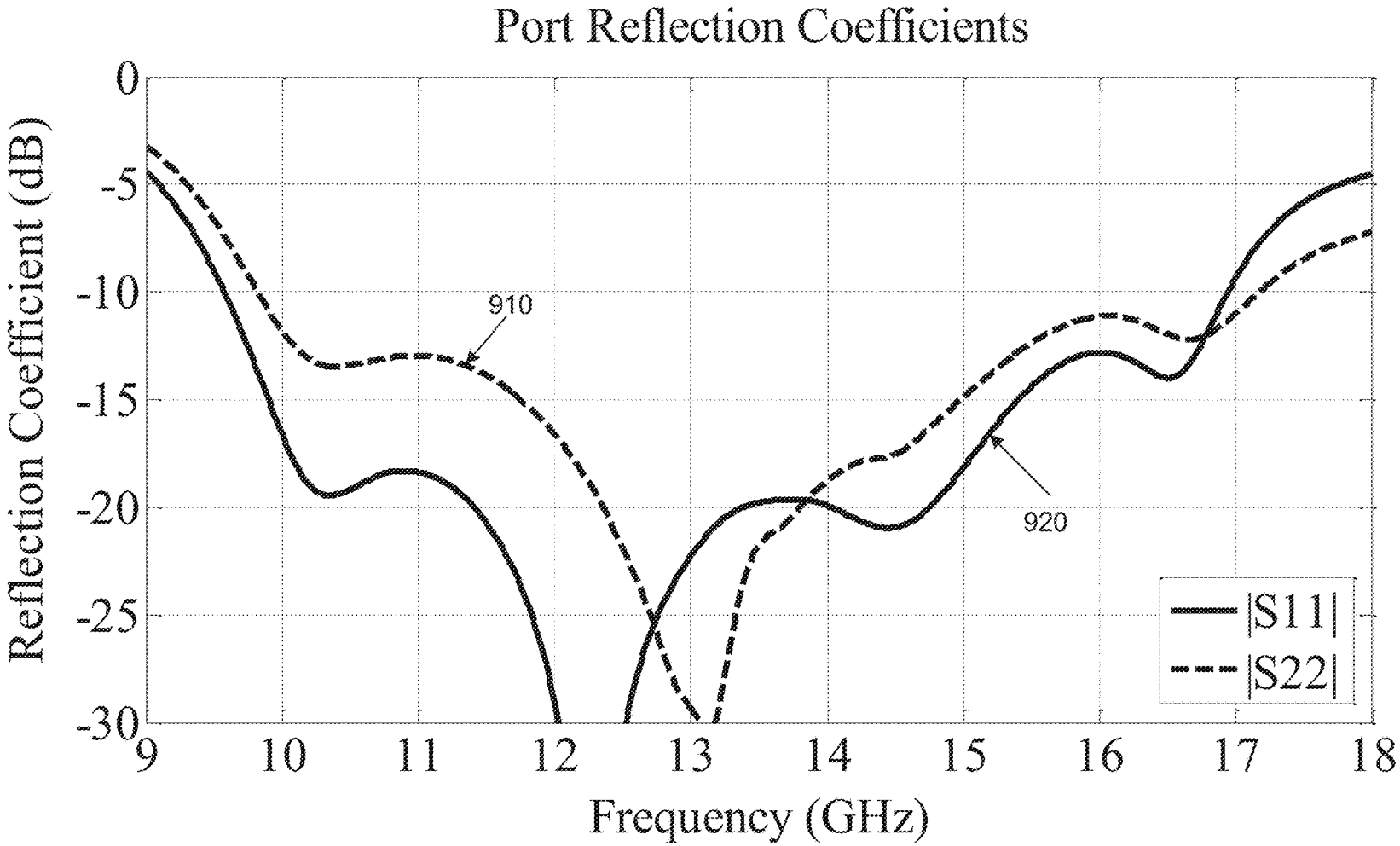
FIG. 9 illustrates example plots of port reflection coefficients as a function of frequency for a model, according to certain aspects.

FIG. 9 illustrates example plots 910 and 920 of port reflection coefficients as a function of frequency for a model, according to certain aspects. The reflection coefficients shown in plots 910 and 920 correspond to ports 1 and 2 of FIG. 5 and reveal an impedance bandwidth of nearly 7 GHz, between 10 and 17 GHz, which corresponds to a reflection coefficient of approximately −10 dB. The impedance bandwidth may also be expressed as a percentage in terms of the ratio of the 10 dB bandwidth (e.g., 7 Ghz) and the mid-band frequency (e.g., 13.5 GHz), which in this case turns out to be approximately 52%.

Figure 10:
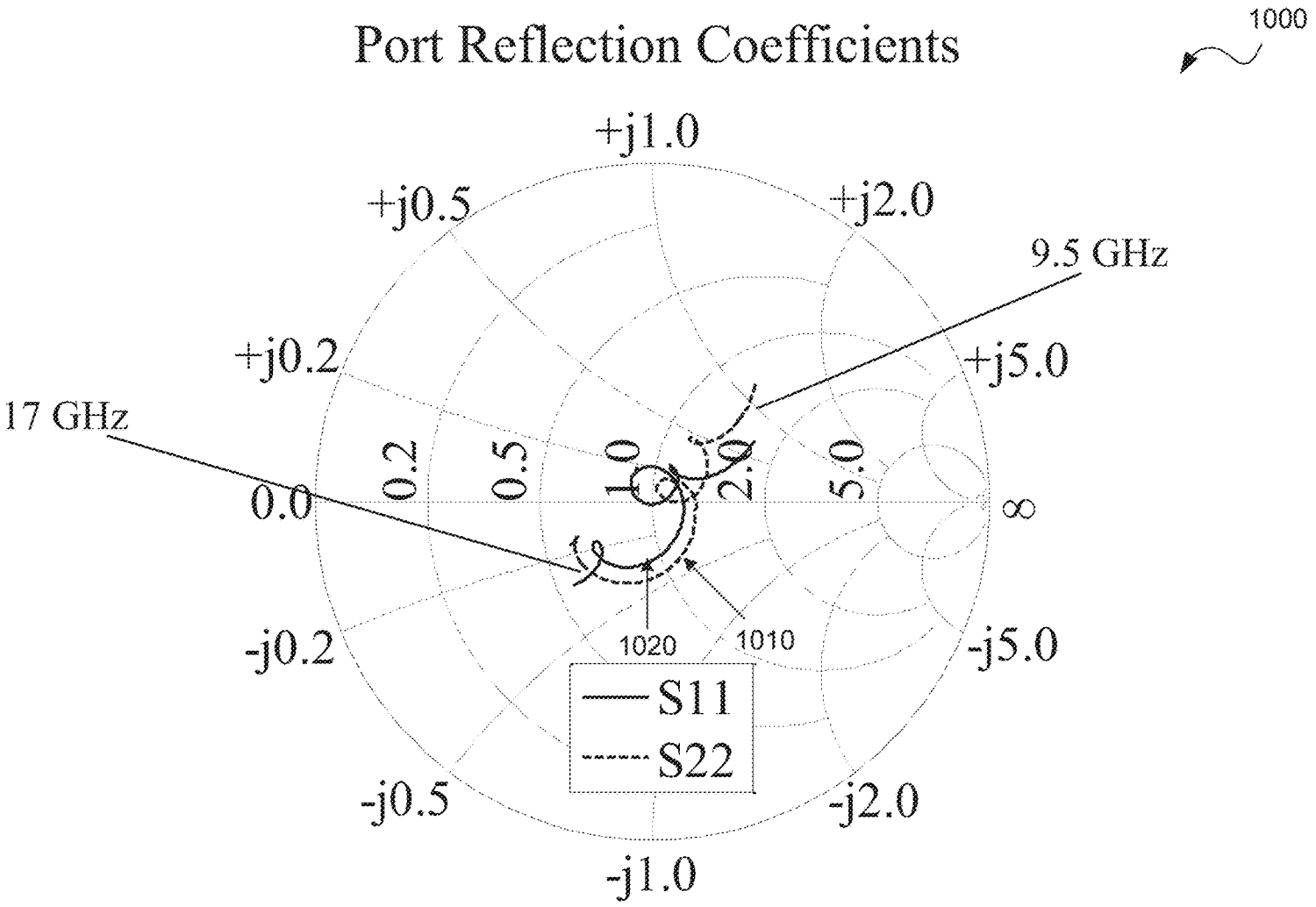
FIG. 10 illustrates an example plot of variation of normalized port impedances as frequency increases from 9.5 to 17 GHz on a Smith chart, according to certain aspects.

FIG. 10 illustrates an example plot 1000 of variation of normalized port impedances 1010 and 1020 as frequency increases from 9.5 to 17 GHz on a Smith chart, according to certain aspects. The plot 1000 shows the behavior of the normalized impedance 1010 and 1020 corresponding to the plots 910 (e.g., for S22 parameter) and 920 (e.g., for S11 parameter) of FIG. 9, as the frequency is varied from 9.5 GHz to 17 GHz.

Figure 11:
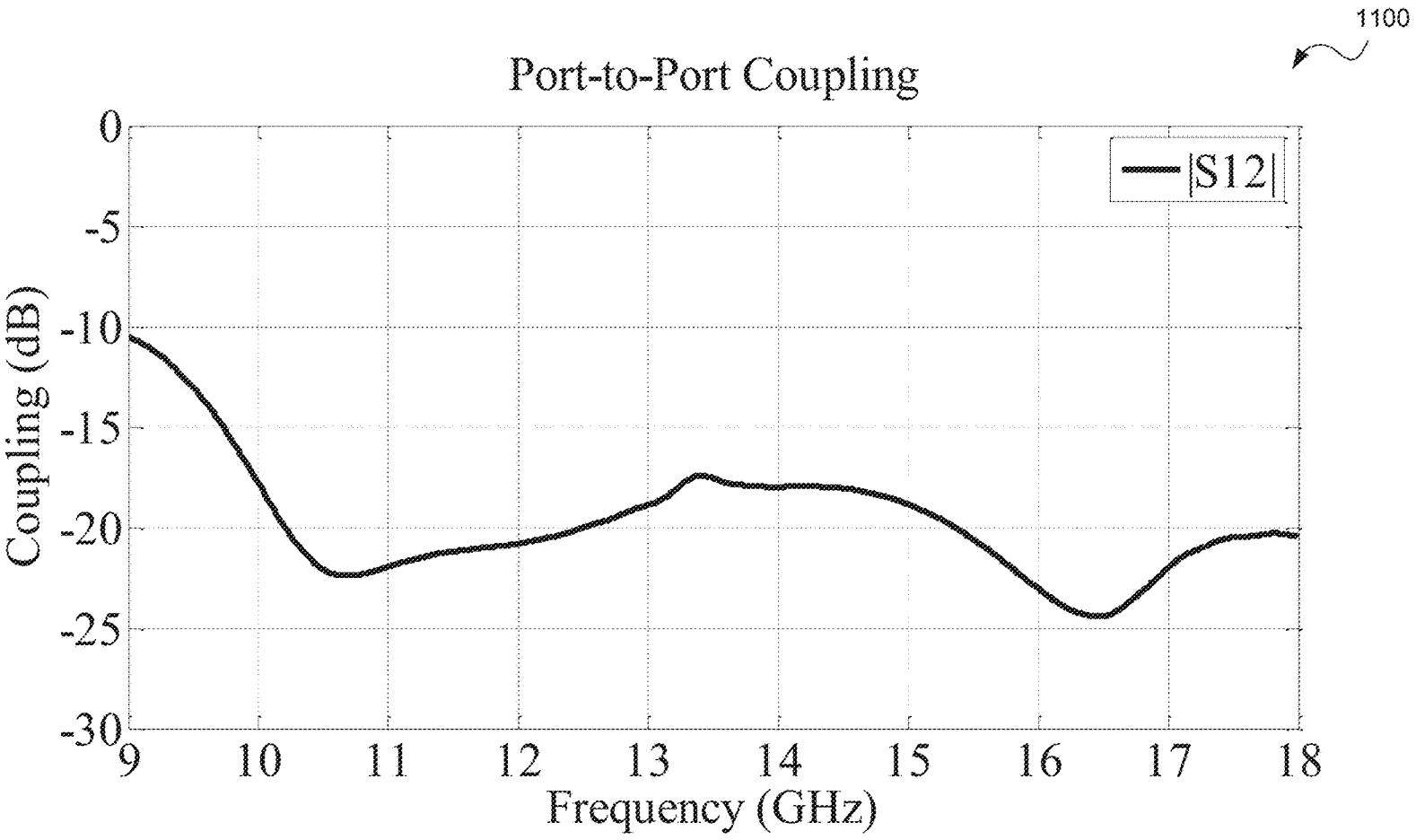
FIG. 11 illustrates an example plot of a coupling between ports as a function of frequency, according to certain aspects.

FIG. 11 illustrates an example plot 1100 of a coupling between ports as a function of frequency, according to certain aspects. The coupling between ports (e.g., ports 1 and 2 of FIG. 5), for the frequency band of interest (e.g., 10.7-14.5 GHz) in VSAT communications, is in the vicinity of −20 dB. This coupling is highly influenced by the orientation of the feed forks (e.g., 322 and 326 of FIG. 3) and can be optimized to approximate −25 dB by shaping the edges of the forks (e.g., 324 and 328 of FIG. 3).

Figure 12:
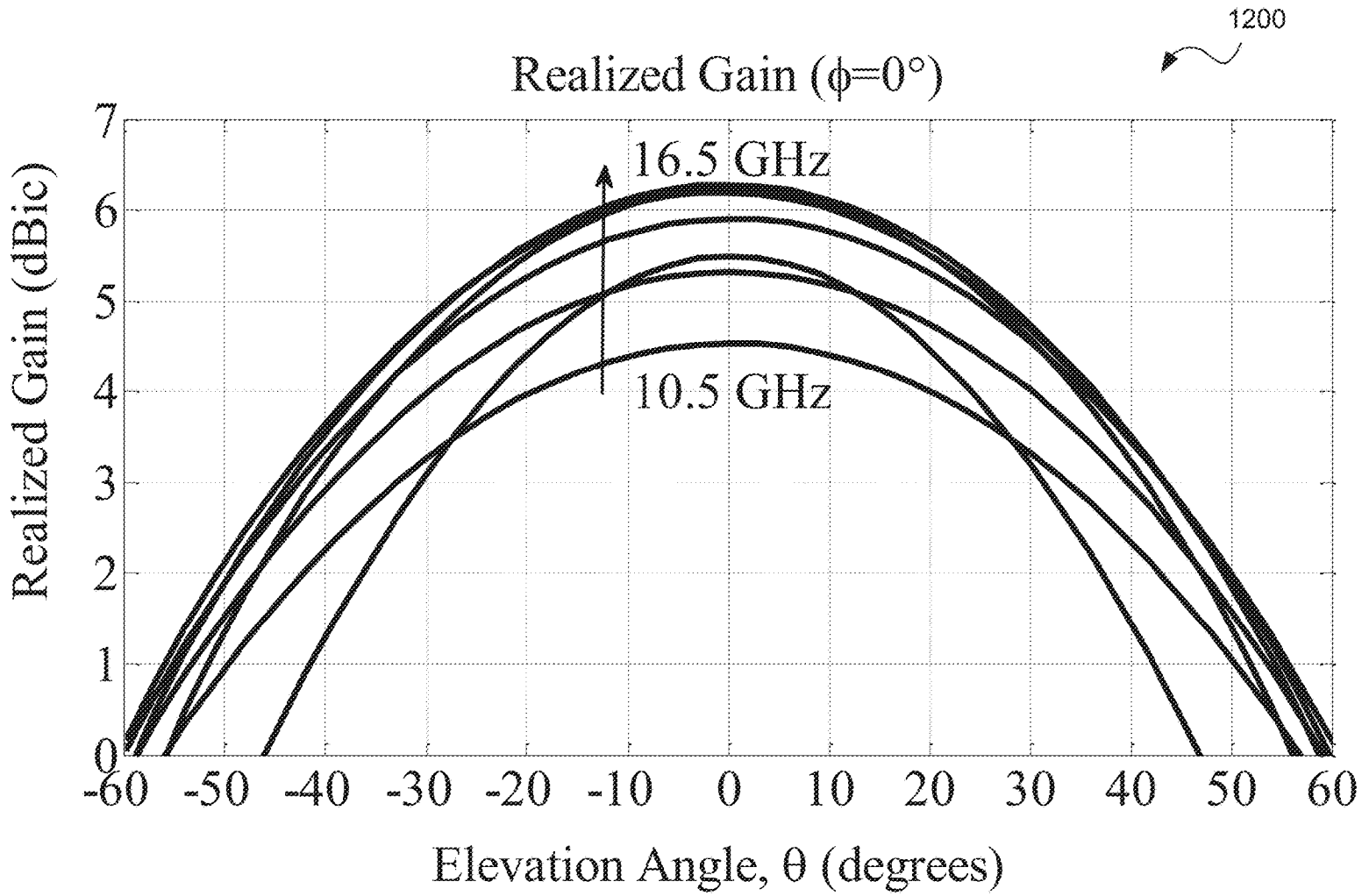
FIGS. 12-14 illustrate example plots of realized gains as a function of frequency for various elevation angles and for three azimuth angles (0, 45, and 90 degrees), according to certain aspects.
Figure 13:
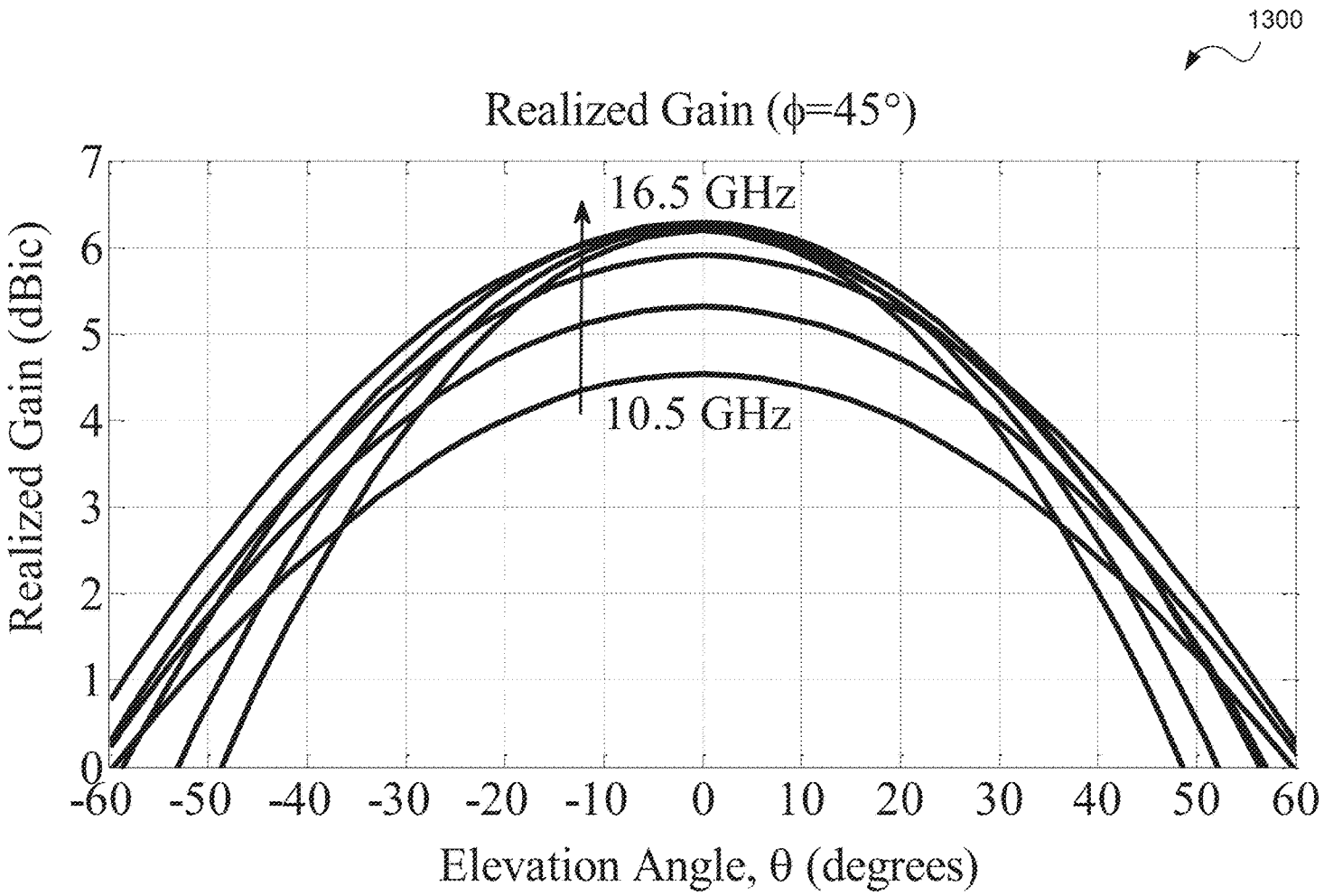
Figure 14:
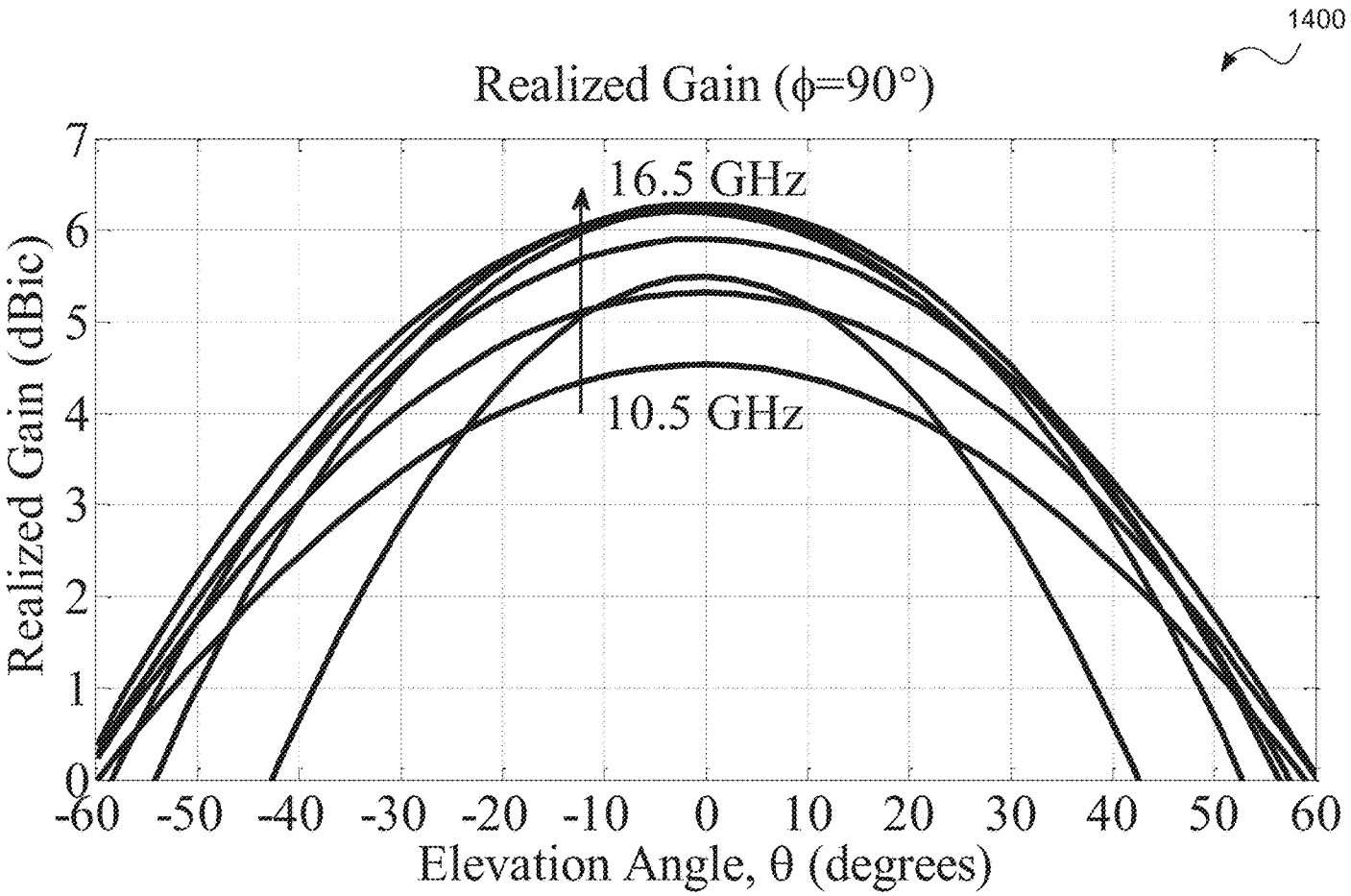

FIGS. 12-14 illustrate example plots 1200, 1300, and 1400 of realized gains as a function of elevation angle for various frequencies and for three azimuth angles (e.g., 0, 45, and 90 degrees), according to certain aspects. The three azimuthal angles, 0, 45 and 90 degrees are sometimes referred to as principle plane, diagonal axis, and cardinal axis, respectively. The gains, as depicted in the plots 1200, 1300, and 1400, show a desired behavior of being maximum at approximately zero elevation and rolling off as the elevation increases. The gain values for the three azimuth angles (e.g., 0, 45, and 90 degrees) increase with frequency, as expected.

Figure 15:
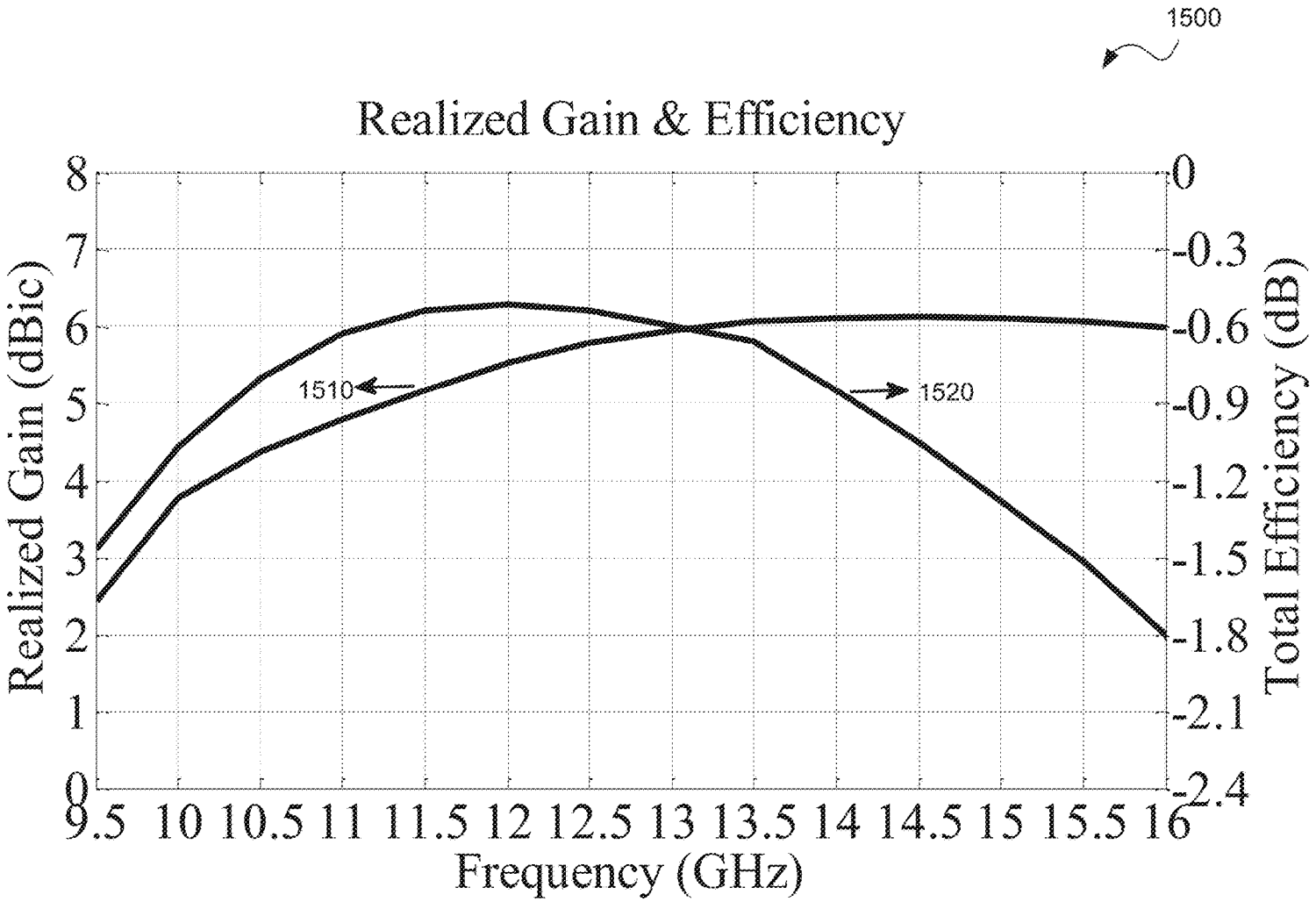
FIG. 15 illustrates example plots of maximum realized gain and efficiency for the antenna model, according to certain aspects.

FIG. 15 illustrates example plots 1510 and 1520 of maximum realized gain and efficiency for the antenna model, according to certain aspects. The plot 1510 summarizes the results shown in FIGS. 12-14 and indicates that the gain, ay expected, increases with frequency. The plot 1520 shows the variation of antenna efficiency as a function of frequency. The gain and efficiency plots show that the antenna design is operable with improved gain and efficiency over a frequency range of 10-17 GHz, which is a desirable feature.

Figure 16:
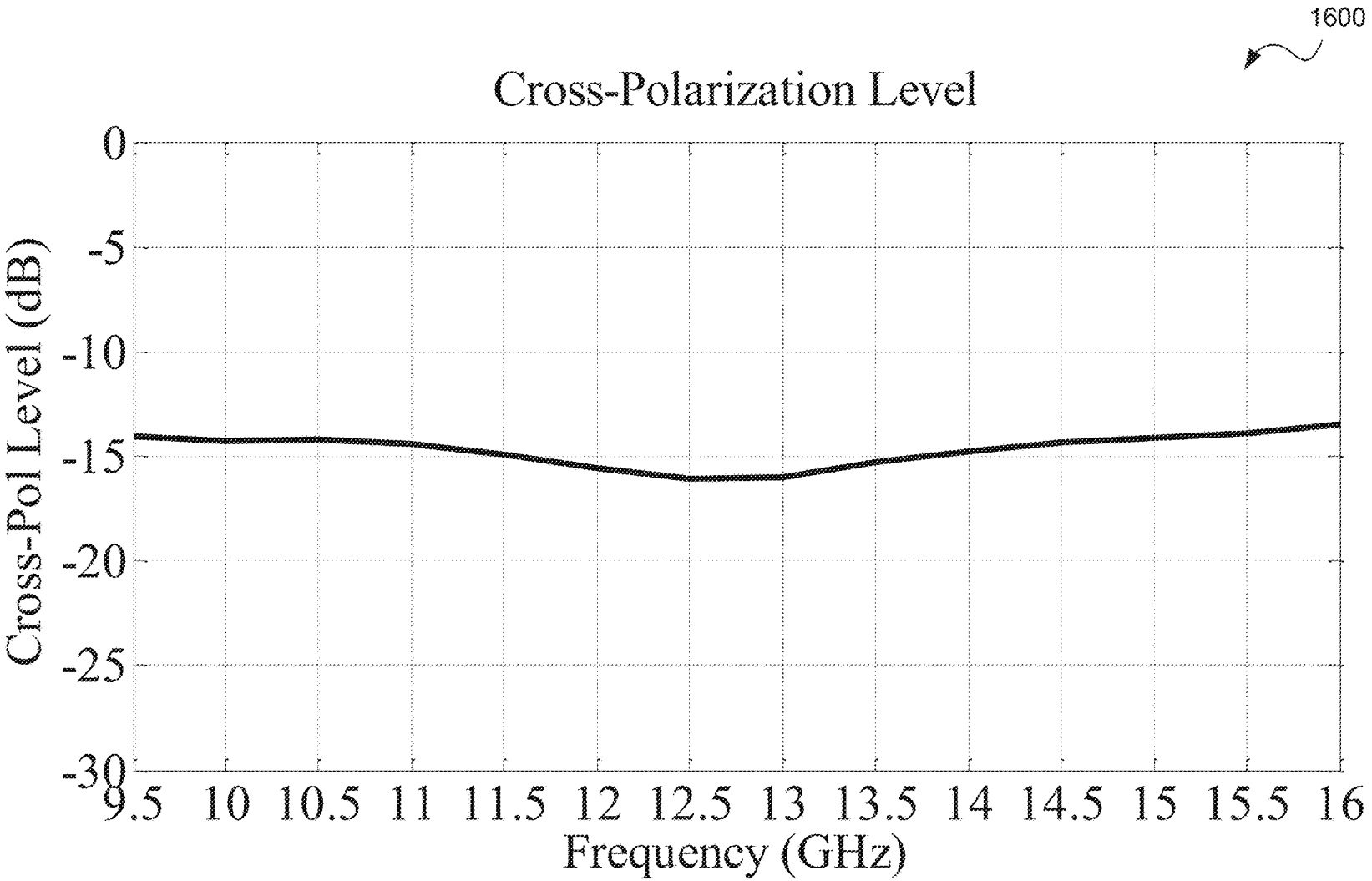
FIG. 16 illustrates an example plot of a normalized cross-polarized realized gain for the antenna model, according to certain aspects.

FIG. 16 illustrates an example plot 1600 of a normalized cross-polarized realized gain for the antenna model, according to certain aspects. The cross-polarized realized gain shown in the plot 1600 is normalized to co-polarized realized gain for the antenna model. The performance specified by the normalized cross-polarized gain, shown in the plot 1600, corresponds to a separate simulation of the hybrid (e.g., the dual-stage hybrid 340) located in the beam-forming layer of FIG. 3.

Figure 17:
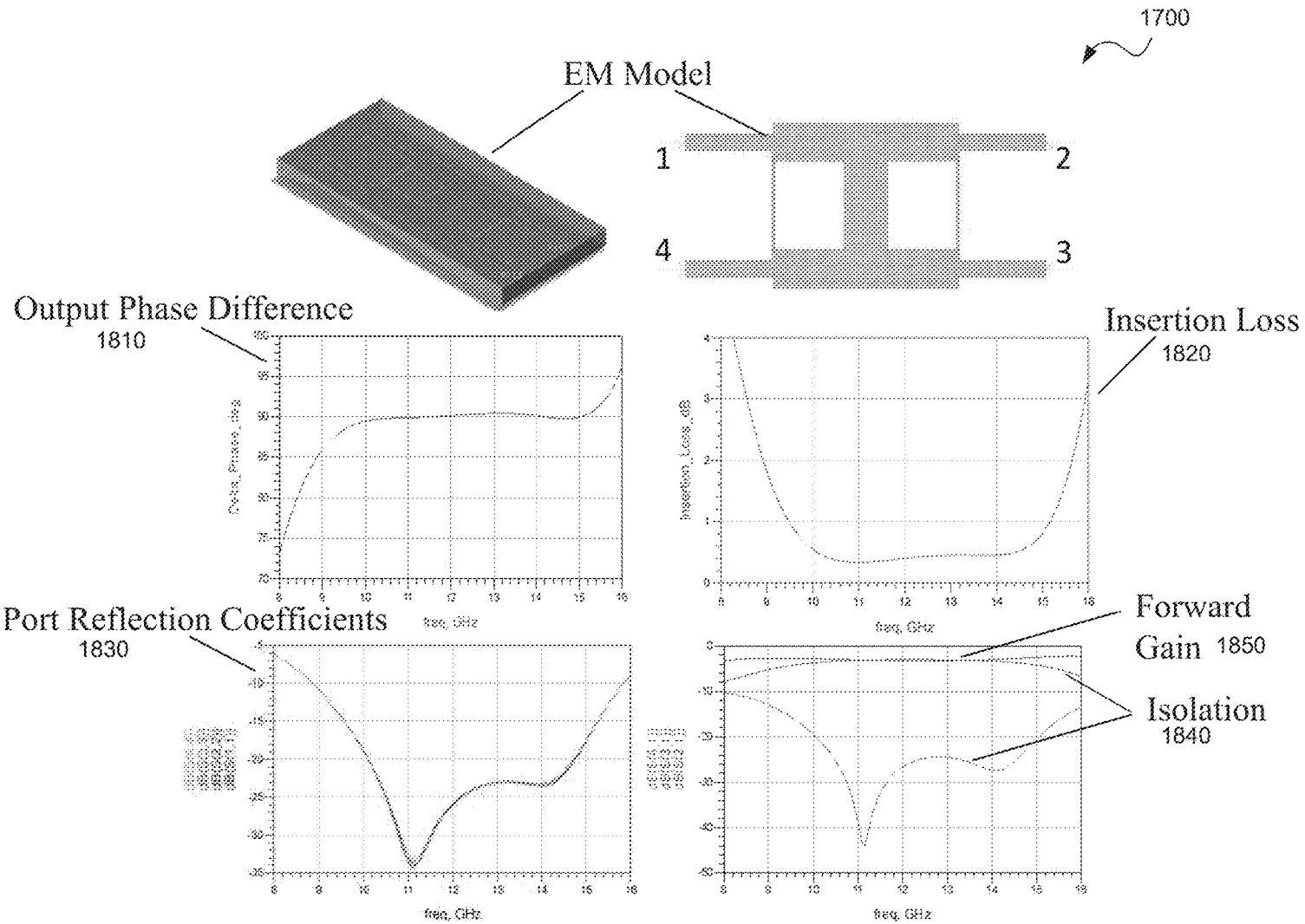
FIG. 17 illustrates exemplary simulation results for the multi-stage stripline coupler used to achieve dual-circular polarization for the antenna model, according to certain aspects.

FIG. 17 illustrates exemplary simulation results for the multi-stage stripline coupler 1700 used to achieve dual-circular polarization for the antenna model, according to certain aspects. The multi-stage stripline coupler 1700 represent an electromagnetic (EM) model of the dual-stage hybrid 340 of FIG. 3, for which the simulation result are shown in plots 1810, 1820, 1830, 1840, and 1850. The ports 1 and 2 may be identified as input port and the ports 3 and 4 may be considered as output ports. The example S-parameters representing the port reflection coefficients (e.g., S11, S22, S33, and S44), port isolation (e.g., S21 and S41), and forward gain (e.g., S31) are with respect to the port number shown in the EM model.

As shown in the plot 1810, the output phase difference is relatively flat at approximately 90 degrees phase difference over a wide range of frequencies (e.g., 10-15 GHz), which includes the VSAT communications operating frequency-band of 10.7-14.5 GHz. The insertion loss, shown by the plot 1820, indicates a desirable value over the same frequency range (e.g., 10-15 GHz). The achieved values of the insertion loss and the bandwidth depend on the number of stages used in the multi-stage stripline coupler 1700. For example, a three-stage implementation can achieve a higher bandwidth at the expense of higher insertion loss, as compared to a two-stage implementation. The port reflection coefficients as represented by S11, S22, S33, and S44 parameters, shown in the plot 1830, tend to go through a minimum at approximately 11 GHz, and remain below approximately −20 dB in the frequency range of interest (e.g., 10-14.5 GHz). The port isolations as represented by S41 and S21 parameters are shown by the plots 1840. The forward gain as represented by S31 parameter of the plot 1850 is relatively flat over the range of frequency of interest.

The antenna model that produces the results shown in FIGS. 12-17 is a Ku-band design as described in, for example, FIGS. 3-5 and FIG. 8. The gain curves (e.g., 12-14) may represent realized gain for circularly polarized excitation, which may include dielectric, ohmic, and mismatch losses of the commercially available materials used to implement the antenna as shown in FIG. 8. All S-parameter data is phase de-embedded to the boundaries of the unit cell and adjusted to equalize time of arrival for each feed. Ports (e.g., 1 and 2 of FIG. 5) may be simultaneously excited with uniform amplitude and quadrature phase for data.

Figure 18:
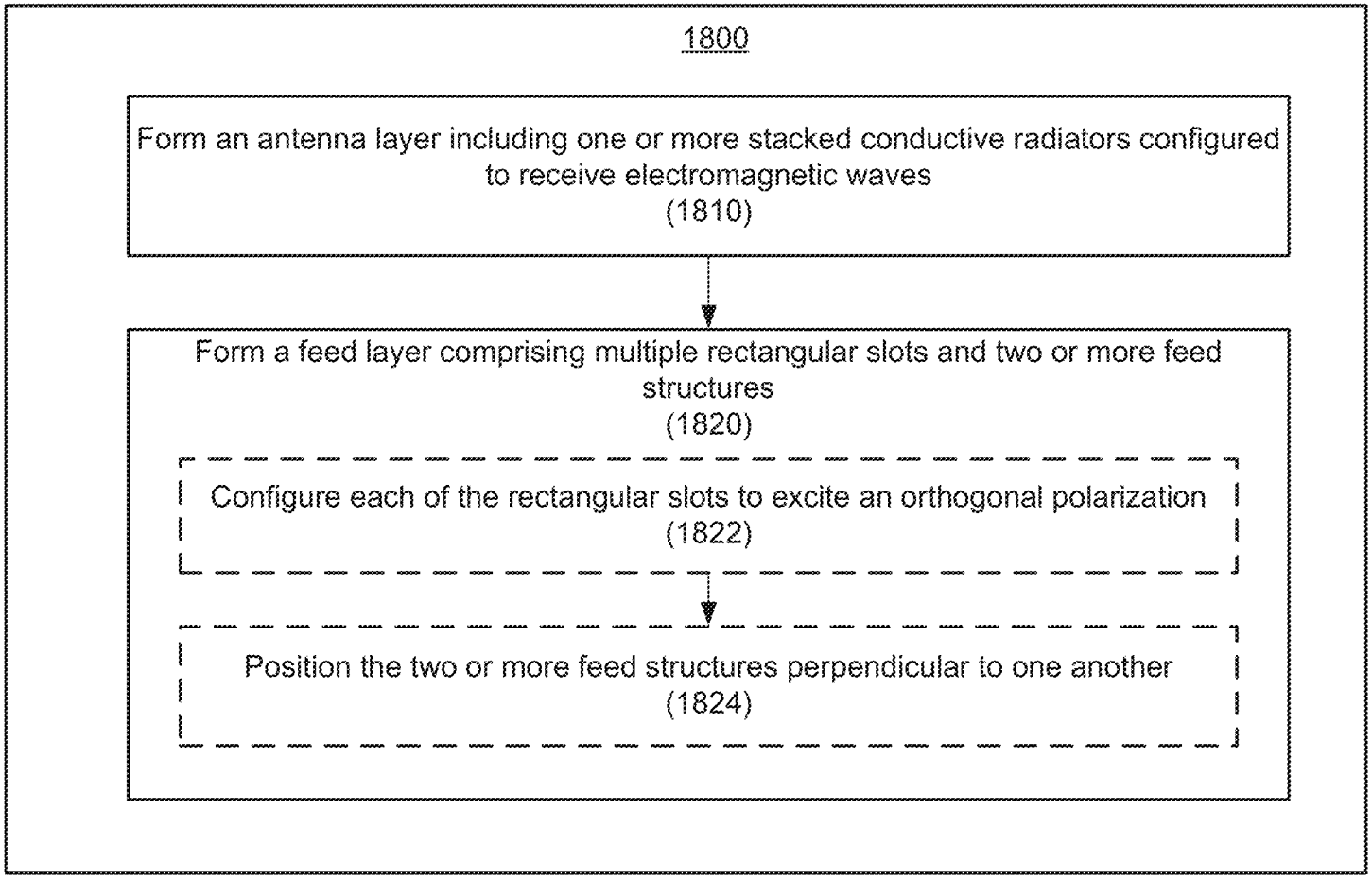
FIG. 18 illustrates a flow diagram of an example of a method for providing a unit cell antenna, according to certain aspects.

FIG. 18 illustrates a flow diagram of an example of a method 1800 for providing a unit cell antenna, according to certain aspects. The steps of the method 1800 do not need to be performed in the order shown and one or more steps may be omitted. The method 1800 may include forming an antenna layer (e.g., 110 of FIG. 1) including one or more stacked conductive radiators (e.g., 112 of FIG. 1) configured to receive electromagnetic waves (1810). A feed layer (e.g., 412 and 416 of FIG. 4) including multiple rectangular slots (e.g., 320 of FIG. 3) and two or more feed structures (e.g., 322 and 326 of FIG. 3 and 424 of FIG. 4) may be formed (1820). The feed layer may be formed by configuring each of the rectangular slots to excite an orthogonal polarization (1822), and positioning the two or more feed structures perpendicular to one another (1824). Each of the feed structures may include a feed fork including a set of open-circuit stubs (e.g., 324 and 328 of FIG. 3) that are configured to tune antenna performance.

In some aspects, the subject technology is related to a wide-band antenna design for wide-scan, low-profile phased arrays. The antenna design of the subject disclosure includes a number of advantageous features, including improved bandwidth, improved scan range corresponding to small unit cells, dual orthogonal polarization, better port isolation, higher gain, and less stringent manufacturing tolerances than the existing solutions. The subject technology may be utilized by a number of markets including, but not limited to, data transmission and communications, advanced sensors, and radar and active phased arrays.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meaning unless otherwise explicitly and clearly defined by the patentee. If there is any conflict in the usages of a word or term in this specification and one or more patent or other documents that may be incorporated herein by reference, the definitions that are consistent with this specification should be adopted.

What is claimed is:

1. An antenna cell for a wide-scan low-profile phased array system, the antenna cell comprising:

an antenna layer comprising one or more stacked conductive radiators configured to receive electromagnetic waves; and a feed layer comprising a plurality of rectangular slots and at least two feed structures, wherein each of the plurality of rectangular slots is configured to excite an orthogonal polarization, wherein the at least two feed structures are positioned perpendicular to one another, and wherein each of the at least two feed structures comprises a feed fork, wherein each feed fork includes two teeth, each tooth ending with a corner stub, and wherein corner stubs of the two teeth have diverging ends extending away from one another.

2. The antenna cell of claim 1, wherein the plurality of rectangular slots are configured to form a cross-shaped dual feed slot with rectangular end stubs.

3. The antenna cell of claim 2, wherein each slot of the cross-shaped dual feed slot is configured to be fed with one of the feed forks, and wherein each of the feed forks is configured to function as a substantially lossless stripline power divider.

4. The antenna cell of claim 1, wherein the at least two feed structures comprise a top-stripline feed structure and a bottom stripline feed structure each coupled to a port.

5. The antenna cell of claim 1, wherein the feed fork including the set of open-circuit stubs and the corner stubs of the two teeth are shaped to reduce coupling between feed forks and to increase port-to-port isolation.

6. The antenna cell of claim 1, wherein the antenna layer comprises compact rectangular radiators that are configured to achieve a wide bandwidth of about 7 GHz.

7. The antenna cell of claim 1, wherein the antenna layer comprises two compact rectangular radiators, and wherein each compact rectangular radiator is to excite an orthogonal polarization of the electromagnetic waves.

8. The antenna cell of claim 1, further comprising a beam-forming layer comprising a plurality of multi-stage branch-line couplers.

9. A method for providing an antenna cell for a wide-scan low-profile phased array system, the method comprising:

forming an antenna layer comprising one or more stacked conductive radiators configured to receive electromagnetic waves; and forming a feed layer comprising a plurality of rectangular slots and at least two feed structures, wherein forming the feed layer comprises:

configuring each of the plurality of rectangular slots to excite an orthogonal polarization, and positioning the at least two feed structures perpendicular to one another, wherein each of the at least two feed structures comprises a feed fork, wherein each feed fork includes two teeth, each tooth ending with a corner stub, and wherein corner stubs of the two teeth have diverging ends extending away from one another.

10. The method of claim 9, further comprising configuring the plurality of rectangular slots to form a cross-shaped dual feed slot with rectangular end stubs.

11. The method of claim 9, further comprising configuring each slot of the cross-shaped dual feed slot to be fed with one of the feed forks, and shaping each of the feed forks to function as a substantially lossless stripline power divider.

12. The method of claim 9, wherein forming the at least two feed structures comprise forming a top-stripline feed structure and a bottom stripline feed structure each coupled to a port.

13. The method of claim 9, further comprising shaping the feed fork including the set of open-circuit stubs and the corner stubs of the two teeth to reduce coupling between feed forks to increase port-to-port isolation.

14. The method of claim 9, wherein forming the antenna layer comprises forming compact rectangular radiators and configuring the compact rectangular radiators to achieve a wide bandwidth of about 7 GHz.

15. The method of claim 9, wherein forming the antenna layer comprises forming two compact rectangular radiators, and shaping each compact rectangular radiator to excite an orthogonal polarizations of the electromagnetic waves.

16. The method of claim 9, further comprising forming a beam-forming layer comprising a plurality of multi-stage branch-line couplers and other components and configuring the beam-forming layer to achieve one of analog or digital beam forming.

* * * * *